US012281447B2

(12) United States Patent
Mi

(10) Patent No.: US 12,281,447 B2
(45) Date of Patent: Apr. 22, 2025

(54) METHOD AND DEVICE FOR LAYING RAIL FOR RAIL TRANSIT

(71) Applicant: Jianjun Mi, Qingdao (CN)

(72) Inventor: Jianjun Mi, Qingdao (CN)

( * ) Notice: Subject to any disclaimer, the term of this patent is extended or adjusted under 35 U.S.C. 154(b) by 641 days.

(21) Appl. No.: 17/634,997

(22) PCT Filed: Jul. 21, 2020

(86) PCT No.: PCT/CN2020/103221
§ 371 (c)(1),
(2) Date: Feb. 14, 2022

(87) PCT Pub. No.: WO2021/031769
PCT Pub. Date: Feb. 25, 2021

(65) Prior Publication Data

US 2022/0290379 A1 Sep. 15, 2022

(30) Foreign Application Priority Data

Aug. 16, 2019 (CN) ..... 201910743340.6

(51) Int. Cl.
*E01B 29/16* (2006.01)
*E01B 29/44* (2006.01)

(52) U.S. Cl.
CPC ..... *E01B 29/16* (2013.01); *E01B 29/44* (2013.01)

(58) Field of Classification Search
CPC ..... E01B 29/00; E01B 29/16; E01B 29/17; E01B 29/44
See application file for complete search history.

(56) References Cited

U.S. PATENT DOCUMENTS

2012/0192756 A1 8/2012 Miller et al.

FOREIGN PATENT DOCUMENTS

| | | | | |
|---|---|---|---|---|
| CN | 1052159 A | | 6/1991 | |
| CN | 101215813 A | | 7/2008 | |
| CN | 101379333 A | * | 3/2009 | ..... E01B 29/16 |
| CN | 103702887 A | | 4/2014 | |
| CN | 204080570 U | | 1/2015 | |
| CN | 107326756 A | | 11/2017 | |
| CN | 208201529 U | | 12/2018 | |

(Continued)

OTHER PUBLICATIONS

Xuewei Lyu, Introduction to Metallurgy, 2017, pp. 106-110, Metallurgical Industry Press.

*Primary Examiner* — Robert J McCarry, Jr.
(74) *Attorney, Agent, or Firm* — Bayramoglu Law Offices LLC

(57) ABSTRACT

A method and a device for laying a rail for rail transit are provided. In the present method for laying a rail for rail transit, the rail is a steel rail, which is fabricated and laid continuously on site; the on-site fabrication of the steel rail adopts at least on-site rolling; the rolling is continuous rolling; there is also a casting process before the steel rail is rolled; and the casting process is a continuous casting process. Through the continuous casting and rolling processes, the rolled steel rail is in a continuous state. The continuous steel rail is laid directly after being fabricated by the continuous casting and rolling processes. By improving the existing equipment, the present disclosure transfers the fabrication process of the steel rail to the rail laying site and directly lays the steel rail into a continuous seamless rail.

6 Claims, 2 Drawing Sheets

(56) References Cited

FOREIGN PATENT DOCUMENTS

| | | | |
|---|---|---|---|
| CN | 109605371 | A | 4/2019 |
| CN | 109797611 | A | 5/2019 |
| CN | 110424198 | A | 11/2019 |
| FR | 2904335 | B1 | 9/2009 |
| RU | 2028406 | C1 | 2/1995 |

* cited by examiner

METHOD AND DEVICE FOR LAYING RAIL FOR RAIL TRANSIT

CROSS REFERENCE TO THE RELATED APPLICATIONS

This application is the national phase entry of International Application No. PCT/CN2020/103221, filed on Jul. 21, 2020, which is based upon and claims priority to Chinese Patent Application No. 201910743340.6, filed on Aug. 16, 2019, the entire contents of which are incorporated herein by reference.

TECHNICAL FIELD

The present disclosure relates to the field of rail transit, and in particular to a method and device for laying a rail for rail transit.

BACKGROUND

Rail transit is a mode of transportation with a long history. Since its appearance, rail transit has become a major mode of transportation because of its large transportation capacity, safety and reliability. The laying of rails, as a basis of rail transit, has been very mature and reliable after years of practice and improvement in terms of various technologies. However, with the continuous advancement of rail technology and other technologies, especially the invention and use of high-speed trains in various countries in the world in recent years, the requirements for the laying of rails have become increasingly high. China's high-speed trains have been running for more than ten years, with a speed of more than 300 km/h. The existing rail laying system can no longer meet the needs, and a large number of rails are being laid every year. The latest existing rail laying method includes: manufacturing steel rails with a length of about 20-100 m in a steel plant, carrying the steel rails by special beam cranes, transporting the steel rails on special roads by special vehicles, laying the steel rails by special machines, cleaning the rail joints and welding the steel rails into a seamless rail. The strength of the welded part of the steel rail can exceed that of the non-welded part, but it is hard to achieve the same physical and chemical indicators as those near the welded part. In addition, the whole process consumes a lot of manpower and material resources. For this reason, an improved technology is urgently needed to achieve faster, more comfortable and safer rail transit.

SUMMARY

An objective of the present disclosure is to provide a method and device for laying a rail for rail transit. The present disclosure solves the problems of high cost and unevenness of rail transit rails that are laid in sections and then welded.

In order to achieve the above objective, the present disclosure is implemented through the following technical solution: a method for laying a rail for rail transit, where the rail is a steel rail, which is fabricated and laid continuously on site; the on-site fabrication of the steel rail at least adopts on-site rolling; the rolling is continuous rolling; there is also a casting process before the steel rail is rolled; and the casting process is a continuous casting process. Through the continuous casting and rolling processes, the rolled steel rail is in a continuous state. The continuous steel rail is laid directly after being fabricated by the continuous casting and rolling processes. Compared with the existing rail laying method, the method of the present disclosure has many revolutionary advantages in fabricating and laying the rail. First, the processes are simplified. The existing rail needs to go through a series of processes from billet casting, billet rolling, rail storage, rail loading, rail transportation, rail laying, rail welding and grinding correction from production to completion. These processes span time and space, wasting time and expense. The method of the present disclosure improves the existing equipment, and transfers the fabrication process of the steel rail to the rail laying site. The present disclosure fabricates the continuous steel rail through the latest existing continuous casting and rolling processes, and directly lays the steel rail into a continuous seamless rail.

In the rail laying method of the present disclosure, rail foundation construction is completed before the rail laying. Both ballasted and ballastless rails require foundation construction. The ballasted rail uses gravel as a rail bed on the subgrade. It requires that the gravel has an even structure, high impact toughness, and is hard, resistant to weathering, elastic, and conducive to drainage. The ballastless rail does not need to lay gravel on the subgrade, but uses an integral roadbed slab. The roadbed slab is prefabricated in the factory at the rear, and it is generally a reinforced concrete structure with a width of 3 m and a length of 5 m. During prefabrication, fasteners are embedded in the rail. The ballastless rail is prefabricated and laid quickly, and allows the train to run more smoothly, but with a high cost. Preferably, the construction of power facilities along the rail is completed before the rail is laid, so as to supply power for related operations during the rail laying process. Foundation construction and power facility construction include two situations, the completion of the entire construction and the completion of part of the construction. For the latter, the construction can be carried out simultaneously with rail laying. For example, foundation construction goes first, then power facilities are put into synchronous construction, and a buffer time is reserved for rail laying, so as to achieve the effect of simultaneous construction.

A device for laying a rail for rail transit, including a steel rail laying apparatus and a steel rail rolling device, where a steel rail output by the steel rail rolling device directly enters the steel rail laying apparatus; the steel rail laying apparatus adjusts a position of the steel rail, fills a rail pad and an elastic frame, and lays the steel rail; the device for laying a rail further includes a continuous casting device; the continuous casting device is connected to the steel rail rolling device to form a continuous casting and rolling device; steel that meets required chemical composition and mass percentage is continuously cast into a continuous billet in the continuous casting device of the continuous casting and rolling device; the billet is directly sent to a continuous rolling unit of the large-reduction continuous rolling device for rolling to obtain an even and continuous steel rail; the steel rail is laid by the steel rail laying apparatus; the device for laying a rail further includes a first carrying device; at least the continuous casting and rolling device is provided on the first carrying device; the first carrying device moves along a rail laying route; when the steel rail rolling device outputs the rail, the first carrying device cooperates to move forward to make the steel rail output smoothly; the device for laying a rail further includes a second carrying device; the second carrying device is provided between the first carrying device and the continuous casting and rolling device; the second carrying device is movable back and forth within the first carrying device at least along a rail laying direction relative to the first carrying device, such that a difference between a speed of the continuous casting and rolling device to output the steel rail and a speed of the first carrying device is adjusted; when there is a speed error, the speed error is compensated by a movement of the second carrying device; the second carrying device is also movable laterally along the steel rail laying route to adjust a lateral deviation; the first carrying device is set to be driven by a wheel or crawler according to an actual rail laying route; and the first carrying device is movable along the steel rail or astride the steel rail. The output rail is fixed, such that the first carrying device and the second carrying device also have a role of drawing the billet. In the prior art, a drawing roller is used to draw the billet and pull the billet out of a mold of a continuous casting device. The present disclosure reduces or eliminates the drawing roller.

Compared with the previous casting mold technology, the continuous casting and rolling device improves the utilization of raw materials, saves energy consumption, improves labor conditions, is easy to realize automation, and improves the quality of cast blank. Therefore, the arc continuous casting machine has been widely used.

In the device for laying a rail for rail transit, tensile force sensors for detecting a tensile force are provided between the steel rail and the continuous rolling device and between the first carrying device and the second carrying device; a position sensor is provided between the first carrying device and the second carrying device to detect a positional movement between the first carrying device and the second carrying device; the second carrying device is provided with a secondary driving device for driving the second carrying device to move on the first carrying device; the first carrying device is provided with a primary driving device for driving the first carrying device to move on a ground; the tensile force sensors, the position sensor, the secondary driving device and the primary driving device are all connected to a controller; the controller is connected to a host computer to control the operation of each part; and the host computer is also used to detect and control the data and operation of other parts.

A continuous rolling method for a steel rail rolls, by a roller that moves relative to the ground, a billet that is fixed or moved relative to a ground.

A continuous rolling device for a steel rail is provided with a moving roller, where a billet is continuously output; and a roller moves back and forth around the billet, making the billet a desired steel rail. The continuous rolling device can be combined with the continuous casting device instead of a billet cutting device and a rail cutting device. The continuous casting device may not be provided with a lead ingot or a lead billet device. By improving the existing continuous casting and rolling device, the present application can realize the continuous output of the steel rail, and at the same time greatly reduce the space length, weight and cost of the continuous casting and rolling device.

A continuous casting and rolling device includes a turret of at least two ladles, a tundish, molds, a guide roller and a roller, where the ladles are provided with a heating device, and the ladles are carried by the turret; molten steel is poured into the tundish, and is distributed to each of the molds from a nozzle of the tundish; the molds cool the molten steel into a billet; the billet is conveyed to the roller of the continuous rolling device through the guide roller in an arc shape; and the roller moves back and forth to roll the billet into a designed rail. The continuous casting and rolling device has a simple structure and can continuously output a rail.

In the device for laying a rail, since the billet is continuously rolled into a continuous rail, the billet is output with a size closest to the rail. The present disclosure enables a billet rolling process that is closest to a minimum amount required. The existing single billets need to consider the efficiency issues caused by the amount of the rail that can be output and rolled from each billet and the size of the billet. The rail rolled from a single billet may need to be cut into multiple sections of a required length. Generally, it is impossible to roll a billet into a rail that just meets the requirement. Therefore, the present disclosure can reduce energy consumption and time.

In the device for laying a rail, the rail laying apparatus is much simpler than the existing rail laying apparatus. The existing rail laying apparatus needs to carry a certain number and length of rails, and the rails are continuously replenished during the laying process. The rail of the rail laying apparatus of the present disclosure is continuous and does not require the processes of loading, unloading and storage of the rail. The rail output by the continuous rolling device can be laid by adjusting the position of the rail laying apparatus, adding a rail pad and fixing, etc.

In the device for laying a rail, an on-site steel steelmaking device can also be added. The molten steel output from the steelmaking device enters the ladle of the continuous casting device. In this part, according to the actual situation, such as the distance between the steel plant and the laid rail, a refining device is generally used. If starting with raw iron ore, the equipment is too bulky and not conducive to the operation of the entire rail laying system. Of course, a special miniaturized complete set of steelmaking equipment can be made and implemented in conjunction with the present disclosure. In this way, a continuous rail can be laid only by continuously adding a steelmaking raw material. The steelmaking device can move with the continuous casting and rolling device in the rail laying route, or it can move along with other device on the outside of the rail laying route alone.

In the device for laying a rail, when the steelmaking device is not installed near the laying route, the continuous casting device may be provided with a molten steel heating device. If steel refining raw materials transported from a distant steel plant do not meet the temperature requirement of continuous casting, they can be heated to a suitable temperature, and then the molten steel that meets the requirement is sent to the next step of the continuous casting device.

In the present disclosure, the method and device for laying a rail can output and lay one rail alone, or simultaneously output and lay multiple rails.

Existing rail welding processes include welding between short rails to produce long rails and welding between long rails. Each welding task includes: grinding and cleaning the welding position, welding, normalizing, air cooling, rough grinding, water cooling, straightening and fine grinding. With the method and device of the present disclosure, such a complicated welding process is eliminated. The existing welding technology cannot guarantee the physical and chemical properties and mechanical properties of the welding position consistent with other positions. For example, the welding position can withstand a force greater than or equal to that at other positions, but it is hard to make the whole rail reach the same level. For a train with a speed of 300 km/h, if there is one welding point every 20 m, the train passes through 250 welding points per minute. A 10-car train has 20 pairs of wheels, so the train needs to pass through 5,000 welding points per minute. The uneven rail force will generate vibration and noise. The speed of the existing trains continues to increase. Therefore, the rail is a very important part of the rail transit. A rail laid using the integrated rail laying technology of the present disclosure can reduce noise.

Rail transit described in the present disclosure includes, but is not limited to, railway systems using steel rails. The material of the rail is not limited to steel, but can also be aluminum. The continuous casting and rolling device is not limited to the processing and fabrication of steel rails, but also includes the processing and fabrication of other rails made of other materials.

Beneficial Effects

The present disclosure has the following beneficial effects. In the present disclosure, the method and device for laying a rail enable continuous production of existing rail fabrication devices of various processes through a series of improvements. The present disclosure is suitable for continuous rail fabrication and laying, and makes the performance of the rail consistent. In addition, the present disclosure greatly improves work efficiency, saves costs, and makes rail transit safer and more comfortable.

Figure 1:
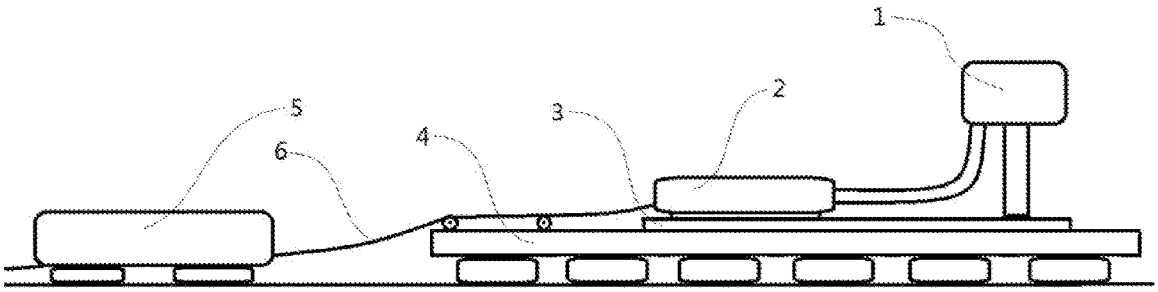
FIG. 1 is a schematic view of a device for laying a rail for rail transit according to the present disclosure.

Reference Numerals: 1. continuous casting device; 2. continuous rolling device; 3. second carrying device; 4. first carrying device; 5. rail laying apparatus; and 6 steel rail.

DETAILED DESCRIPTION OF THE EMBODIMENTS

The present disclosure will be further described below with reference to specific embodiments. FIG. 1 is a schematic view of a device for laying a rail for rail transit according to the present disclosure. The reference numerals in the figure are respectively as follows: 1. continuous casting device; 2. continuous rolling device; 3. second carrying device; 4. first carrying device; 5. rail laying apparatus; and 6. rail. The continuous casting device 1 includes two ladle turrets, a tundish, molds and a guide roller, etc. The ladles are provided with a heating device, and the ladles are carried by the turret. Molten steel is poured into the tundish, and is distributed to each of the molds from a nozzle of the tundish. The molds cool the molten steel into billets. The billets are conveyed to a roller of the continuous rolling device through the guide roller in an arc shape. The roller moves back and forth to roll the billet into a designed rail 6. A rail 1 output by the continuous rolling device 2 directly enters the rail laying apparatus 5. The rail laying apparatus 5 adjusts a position of the rail 1, adds a rail pad and an elastic frame, and lays the rail 1. The continuous casting device 1 and the continuous rolling device 2 are provided on the first carrying device 4. The first carrying device 4 moves along a rail laying route, such that the rail 1 is output smoothly. The second carrying device 3 is provided on the first carrying device 4 and located below the continuous casting device 1 and the continuous rolling device 2. The second carrying device 3 is movable back and forth at least relative to the first carrying device 4 in a rail laying direction. This design allows an adjustment in a difference between a speed of the continuous casting device 1 and the continuous rolling device 2 to output the rail 1 and a speed of the first carrying device 4. When a speed error occurs, it is compensated by a movement of the second carrying device 3. The second carrying device 3 is also movable laterally along the rail laying route for adjusting a lateral deviation. Tensile force sensors for detecting a tensile force are provided between the rail 6 and the continuous rolling device 2 and between the first carrying device 4 and the second carrying device 3. A position sensor is provided between the first carrying device 4 and the second carrying device 3 to detect a positional movement between the first carrying device 4 and the second carrying device 3. The second carrying device 3 is provided with a secondary driving device for driving the second carrying device 3 to move on the first carrying device 4. The first carrying device 4 is provided with a primary driving device for driving the first carrying device 4 to move on a ground. The tensile force sensors, the position sensor, the secondary driving device and the primary driving device are all connected to a controller. The controller is connected to a host computer to control the operation of each part. The host computer is also used to detect and control the data and operation of other parts. The rail laying apparatus 5 may also be provided on the first carrying device 4 or the second carrying device 3.

Figure 2:
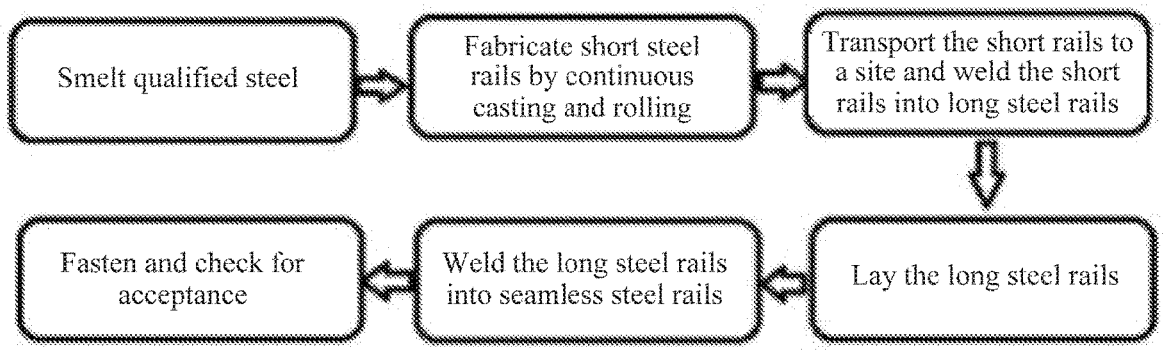
FIG. 2 is a flowchart of the latest seamless rail laying.
Figure 3:
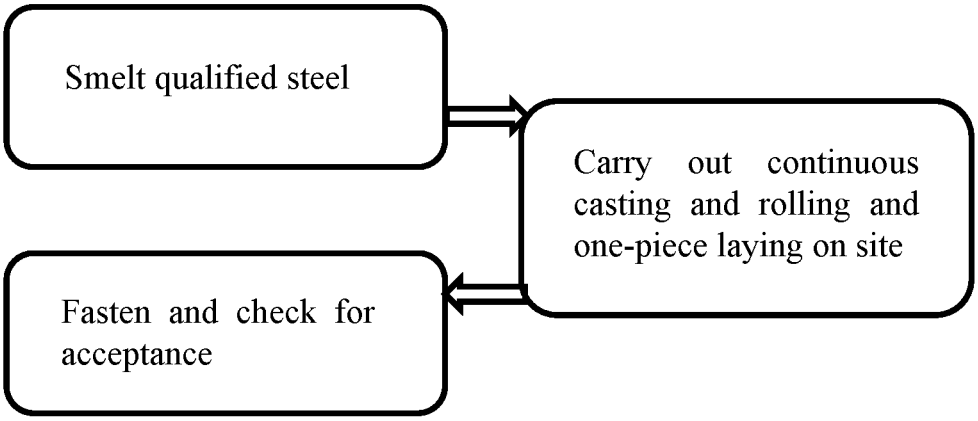
FIG. 3 is a flowchart of a method for laying a rail for rail transit according to the present disclosure.

FIG. 2 is a flowchart of the latest seamless rail laying. FIG. 3 is a flowchart of a method for laying a rail for rail transit according to the present disclosure. It can be seen from the comparison of the two figures that the method of the present disclosure is simpler, saves many processes and special equipment, and achieves higher rail consistency, thereby providing a good foundation for the speed-up and stable operation of rail transit.

The above-mentioned embodiments of the present disclosure are only used to illustrate the present disclosure, and the common-sense technologies and principles in steelmaking and continuous casting and rolling will not be described again. The present disclosure can be used in various changes and combinations according to the prior art, but these changes and combinations are all within the protection scope of the present application.

What is claimed is:

1. A device for laying a rail for rail transit, comprising:

a continuous casting device;

a continuous rolling device;

a first carrying device;

a second carrying device; and a steel rail laying apparatus;

wherein the rail is a steel rail formed by an on-site fabrication, the rail is continuously laid on site, and the on-site fabrication of the steel rail comprises at least continuous casting and rolling processes;

wherein the continuous casting device and the continuous rolling device output the steel rail being uniform and continuous, and the steel rail is laid by the steel rail laying apparatus; and wherein the continuous casting device and the continuous rolling device are both located on top of the second carrying device, and the second carrying device is located on top of the first carrying device, the first carrying device is configured to move along a rail laying route, the second carrying device is configured to move back and forth at least along a rail laying direction relative to the first carrying device, and the second carrying device is further configured to move laterally along the rail laying route.

2. The device for laying the rail for rail transit according to claim 1, wherein a first tensile force sensor is provided between the steel rail and the continuous rolling device, and a second tensile force sensor is provided between the first carrying device and the second carrying device; a position sensor is provided between the first carrying device and the second carrying device; the second carrying device is provided with a secondary driving device for driving the second carrying device to move on the first carrying device; the first carrying device is provided with a primary driving device for driving the first carrying device to move on a ground; the first tensile force sensor, the second tensile force sensor, the position sensor, the secondary driving device, and the primary driving device are all connected to a controller; and the controller is connected to a host computer.

3. The device for laying the rail for rail transit according to claim 1, wherein the continuous casting device comprises a turret of at least two ladles, a tundish, molds, a guide roller, and a roller, wherein the ladles are provided with a heating device, and the ladles are carried by the turret; a molten steel is poured into the tundish, and is distributed to each of the molds from a nozzle of the tundish; the molds cool the molten steel into a billet; the billet is conveyed to the roller through the guide roller in an arc shape; and the roller moves back and forth to roll the billet into a designed rail.

4. The device for laying the rail for rail transit according to claim 1, wherein an on-site steelmaking process is further provided before the continuous casting and rolling processes.

5. The device for laying the rail for rail transit according to claim 1, wherein a rail foundation construction is completed before the rail is laid.

6. The device for laying the rail for rail transit according to claim 1, wherein a continuous rolling method of the continuous casting device and the continuous rolling device comprises: rolling, by a roller moving relative to a ground, a billet fixed or moved relative to the ground.

* * * * *